US011506396B2

(12) United States Patent
Lee et al.

(10) Patent No.: US 11,506,396 B2
(45) Date of Patent: Nov. 22, 2022

(54) OVEN

(71) Applicant: SAMSUNG ELECTRONICS CO., LTD., Suwon-si (KR)

(72) Inventors: Sang-Jin Lee, Suwon-si (KR); Myoung Keun Kwon, Suwon-si (KR); Jung Hak Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 110 days.

(21) Appl. No.: 17/047,972

(22) PCT Filed: Apr. 5, 2019

(86) PCT No.: PCT/KR2019/004096
§ 371 (c)(1),
(2) Date: Oct. 15, 2020

(87) PCT Pub. No.: WO2019/208953
PCT Pub. Date: Oct. 31, 2019

(65) Prior Publication Data

US 2021/0215345 A1 Jul. 15, 2021

(30) Foreign Application Priority Data

Apr. 26, 2018 (KR) ..... 10-2018-0048737

(51) Int. Cl.
*F24C 15/00* (2006.01)
*F24C 15/02* (2006.01)
*F24C 15/20* (2006.01)

(52) U.S. Cl.
CPC ..... *F24C 15/006* (2013.01); *F24C 15/02* (2013.01); *F24C 15/2007* (2013.01)

(58) Field of Classification Search
None
See application file for complete search history.

(56) References Cited

U.S. PATENT DOCUMENTS

2004/0129692 A1* 7/2004 Kim ..... F24C 7/087 219/400

FOREIGN PATENT DOCUMENTS

EP 0 900 985 B1 5/2003
KR 20-1998-0008899 U 4/1998
(Continued)

OTHER PUBLICATIONS

International Search Report dated Aug. 7, 2019, in corresponding International Patent Application No. PCT/KR2019/004096.
(Continued)

*Primary Examiner* — Jason Lau
(74) *Attorney, Agent, or Firm* — Staas & Halsey LLP

(57) ABSTRACT

Provided is an oven comprising an air guide configured to guide the flow of air discharged from a discharge passage. The oven comprises: a main body having an open cavity; a door for opening and closing the oven cavity; a handle disposed on the upper portion of the front surface of the door; an air blower fan disposed on the top of the oven cavity so as to blow air suctioned from the outside of the main body; the discharge passage configured to discharge the air suctioned by the air blower fan to the outside of the main body; and the air guide disposed on one end of the discharge passage so as to divide the flow of air discharged through the discharge passage into an upper portion and a lower portion.

13 Claims, 10 Drawing Sheets

(56) References Cited

FOREIGN PATENT DOCUMENTS

| | | | |
|---|---|---|---|
| KR | 10-2001-0108981 | A | 12/2001 |
| KR | 10-0649602 | B1 | 11/2006 |
| KR | 10-2015-0030016 | A | 3/2015 |

OTHER PUBLICATIONS

Korean Office Action dated Feb. 23, 2022 in Korean Patent Application No. 10-2018-0048737.

* cited by examiner

OVEN

CROSS-REFERENCE TO RELATED APPLICATIONS

This application is a U.S. National Stage Application which claims the benefit under 35 U.S.C. § 371 of International Patent Application No. PCT/KR2019/004096 filed on Apr. 5, 2019, which claims foreign priority benefit under 35 U.S.C. § 119 of Korean Patent Application 10-2018-0048737 filed on Apr. 26, 2018, in the Korean Intellectual Property Office, the contents of both of which are incorporated herein by reference.

TECHNICAL FIELD

The present disclosure relates to an oven including an air guide provided to guide the flow of air discharged from a discharge passage.

BACKGROUND ART

In general, an oven is an apparatus that cooks food by including a cooking chamber, a heating device that applies heat to the cooking chamber, and a circulation device that circulates heat generated by the heating device in the cooking chamber.

An oven is an apparatus that cooks food by sealing and heating food, and may generally be classified into an electric type, a gas type, and an electronic type according to a heat source.

Electric ovens use electric heaters as a heat source, and gas ovens and microwave ovens use heat of gas and frictional heat of water molecules due to high frequencies as heat sources, respectively.

In the case of cooking using an oven, an inside temperature of a cooking chamber may rise to 150 to 450 degrees Celsius according to the cooking conditions, and an outside temperature of the cooking chamber may also rise together.

When the outside temperature of the cooking chamber rises, electronic devices inside the oven may fail due to the effect of thermal shock, and thus the oven may include a blowing device such as a discharge passage to cool the outside of the cooking chamber.

The cooking chamber and the discharge passage may be connected through the cooking chamber passage, in the case of cooking using an oven, water vapor generated from food may be discharged to the discharge passage through the cooking chamber passage, and water vapor discharged into the discharge passage may be discharged to the outside of the oven together with the air discharged through the discharge passage.

In this case, the discharged high-temperature and high-humidity water vapor comes into contact with a handle of a door, so that moisture condensation may occur on the handle of the door.

In addition, high-temperature and high-humidity water vapor in the cooking chamber leaks between a front panel disposed on a front surface of the cooking chamber and the door, so that the water vapor may be discharged to the outside of the oven together with the air discharged through the discharge passage, and in this case, the leaked high-temperature and high-humidity water vapor may cause moisture condensation on the handle of the door.

DISCLOSURE

Technical Problem

The present disclosure is directed to providing an oven including an improved air guide to prevent moisture condensation on a handle of a door.

The present disclosure is particularly directed to an oven including an improved air guide to prevent moisture from condensing on a portion of a handle positioned near a locking device provided between a front surface and the handle of a door.

The present disclosure is directed to an oven including an improved air guide to move upward a part of air discharged through a discharge passage so that water vapor in a cooking chamber discharged to the discharge passage through a cooking chamber passage is prevented from coming into contact with a handle.

The present disclosure is directed to an oven including an improved air guide to move downward a part of air discharged through a discharge passage so that water vapor in a cooking chamber leaking between a front panel and a door is prevented from coming into contact with a handle.

Technical Solution

One aspect of the present disclosure provides an oven including a main body having a cooking chamber, a door configured to open and close the cooking chamber, a handle disposed at an upper portion of a front surface of the door, a blowing fan disposed above the cooking chamber to blow air sucked from outside of the main body, a discharge passage configured to allow air sucked by the blowing fan to be discharged to the outside of the main body, and an air guide disposed at one end of the discharge passage to separate the flow of air discharged through the discharge passage into an upper part and a lower part.

The air guide may be disposed at an upper portion of a front panel provided on a front of the main body.

The oven may further include a cooking chamber passage provided at an upper portion of the cooking chamber to discharge air in the cooking chamber to the discharge passage, wherein the air guide may be configured to move a part of air discharged through the discharge passage upward to prevent water vapor discharged to the discharge passage through the cooking chamber passage from coming into contact with the handle together with air discharged through the discharge passage.

The discharge passage may be formed by a passage base disposed above the cooking chamber and a passage cover covering the passage base, and the air guide may be disposed between an upper portion of the front panel and the passage cover.

The oven may further include an electric component room provided above the cooking chamber to accommodate electric components, and an electric component room cover covering a front surface of the electric component room, wherein the air guide may be disposed between the upper portion of the front panel and the electric component room cover.

The door may include a locking device configured to detachably connect the door to the main body, and the air guide may be disposed at a position opposite to the position of the locking device to prevent moisture from condensing on a portion of the locking device disposed between the front surface of the door and the handle.

The air guide may be configured to move a part of air discharged through the discharge passage downward to prevent water vapor in the cooking chamber leaking between the main body and the door from coming into contact with the handle together with air discharged through the discharge passage.

The air guide may include a guide part configured to guide air discharged through the discharge passage, and a mounting part extending from the guide part to mount the air guide.

The guide part may include a first guide portion spaced upward from the mounting part to separate the flow of air discharged through the discharge passage, and a second guide portion bent downward from the first guide portion to move a part of air discharged through the discharge passage downward.

The first guide portion may include a main body portion from which the second guide portion extends, and a connection portion extending from the main body portion so that the first guide portion is connected to the mounting part.

The guide part may further include a third guide portion bent downward from the second guide portion.

The first guide portion and the third guide portion may be formed in a plane, and the second guide portion may be formed in a curved surface.

The air guide may include a cover support part configured to support the passage cover to maintain a spacing between the passage base and the passage cover.

The air guide may include a guide support part configured to support the first guide portion to maintain a spacing between the mounting part and the first guide portion.

A plurality of the mounting parts may be provided at opposite sides of the first guide portion, and the first guide portion may include a main body portion connected to the second guide portion and connected to one of the plurality of mounting parts, and a connection portion extending from one side of the main body portion and connected to the other one of the plurality of mounting parts.

Another aspect of the present disclosure provides an oven including a main body having a cooking chamber, a door configured to open and close the cooking chamber, a handle disposed at an upper portion of a front surface of the door, a blowing fan disposed above the cooking chamber to blow air sucked through an inlet provided to allow outside air to be introduced into the main body, a discharge passage configured to flow air sucked by the blowing fan through a discharge port provided to allow the air to be discharged to outside of the main body, a cooking chamber passage provided at an upper portion of the cooking chamber to discharge air in the cooking chamber to the discharge passage, and an air guide configured to separate the flow of air discharged through the discharge passage to prevent moisture from condensing on the handle by water vapor discharged to the discharge passage through the cooking chamber passage and water vapor in the cooking chamber leaking between the main body and the door.

The air guide may be disposed at one end of the discharge passage directing to the door.

The door may include a locking device configured to detachably connect the door to the main body, and the air guide may be disposed near the locking device to prevent moisture from condensing on a portion of the locking device disposed between the front surface of the door and the handle.

Another aspect of the present disclosure provides an oven including a main body having a front panel, a door configured to open and close an opening of the front panel, a blowing fan configured to blow outside air sucked into the main body, a discharge passage configured to flow air sucked by the blowing fan to outside of the main body, and an air guide including a first guide portion spaced upward from an upper portion of the front panel, a second guide portion extending frontward from the first guide portion to move a part of air discharged through the discharge passage downward, and a third guide portion extending downward from the second guide portion.

The may be air guide disposed at the upper portion of the front panel to separate the flow of air discharged through the discharge passage.

Advantageous Effects

The present disclosure can prevent moisture from condensing on a handle of a door by including an air guide.

The present disclosure can particularly prevent moisture from condensing on a portion of the handle positioned near a locking device provided between a front surface and the handle of the door by including the air guide.

The present disclosure can move upward a part of air discharged through a discharge passage by including the air guide so that water vapor in a cooking chamber discharged to the discharge passage through a cooking chamber passage is prevented from coming into contact with the handle.

The present disclosure can move downward a part of air discharged through the discharge passage by including the air guide so that water vapor in the cooking chamber leaking between a front panel and the door is prevented from coming into contact with the handle.

MODE OF THE DISCLOSURE

Figure 1:
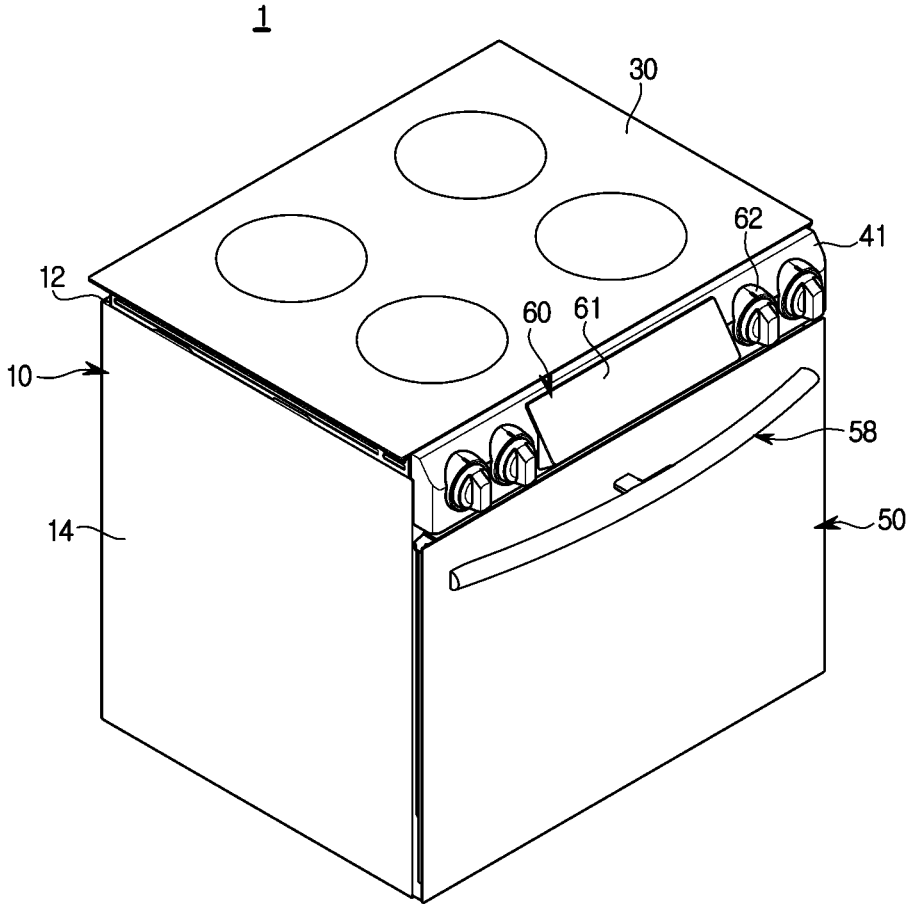
FIG. 1 is a perspective view of an oven according to the present disclosure.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise.

The terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another.

For example, without departing from the scope of the present disclosure, the first component may be referred to as a second component, and similarly, the second component may also be referred to as a first component. The term "and/or" includes any combination of a plurality of related items or any one of a plurality of related items.

In this specification, the terms "front end," "rear end," "upper portion," "lower portion," "upper end" and "lower end" used in the following description are defined with reference to the drawings, and the shape and position of each component are not limited by these terms.

Hereinafter, embodiments of the present disclosure will be described in detail with reference to the accompanying drawings.

Figure 2:
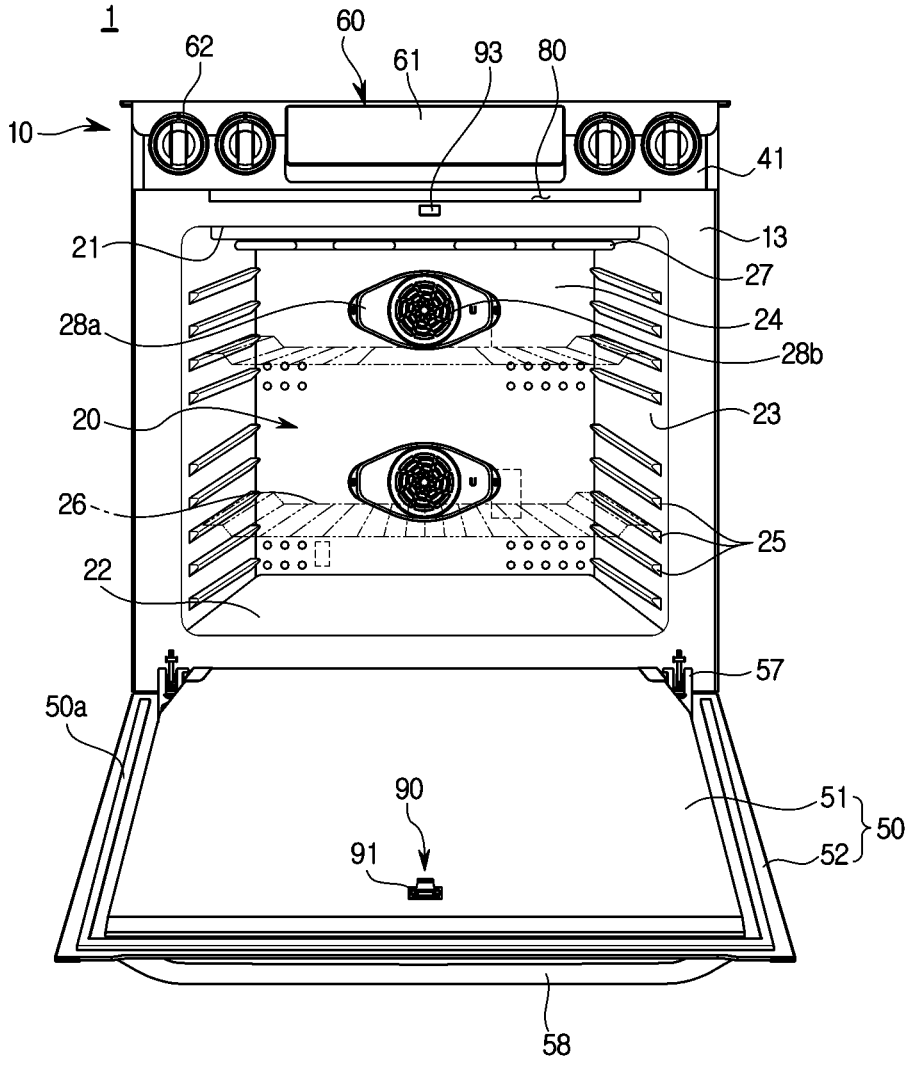
FIG. 2 illustrates a state in which a door of the oven according to the present disclosure is opened.
Figure 3:
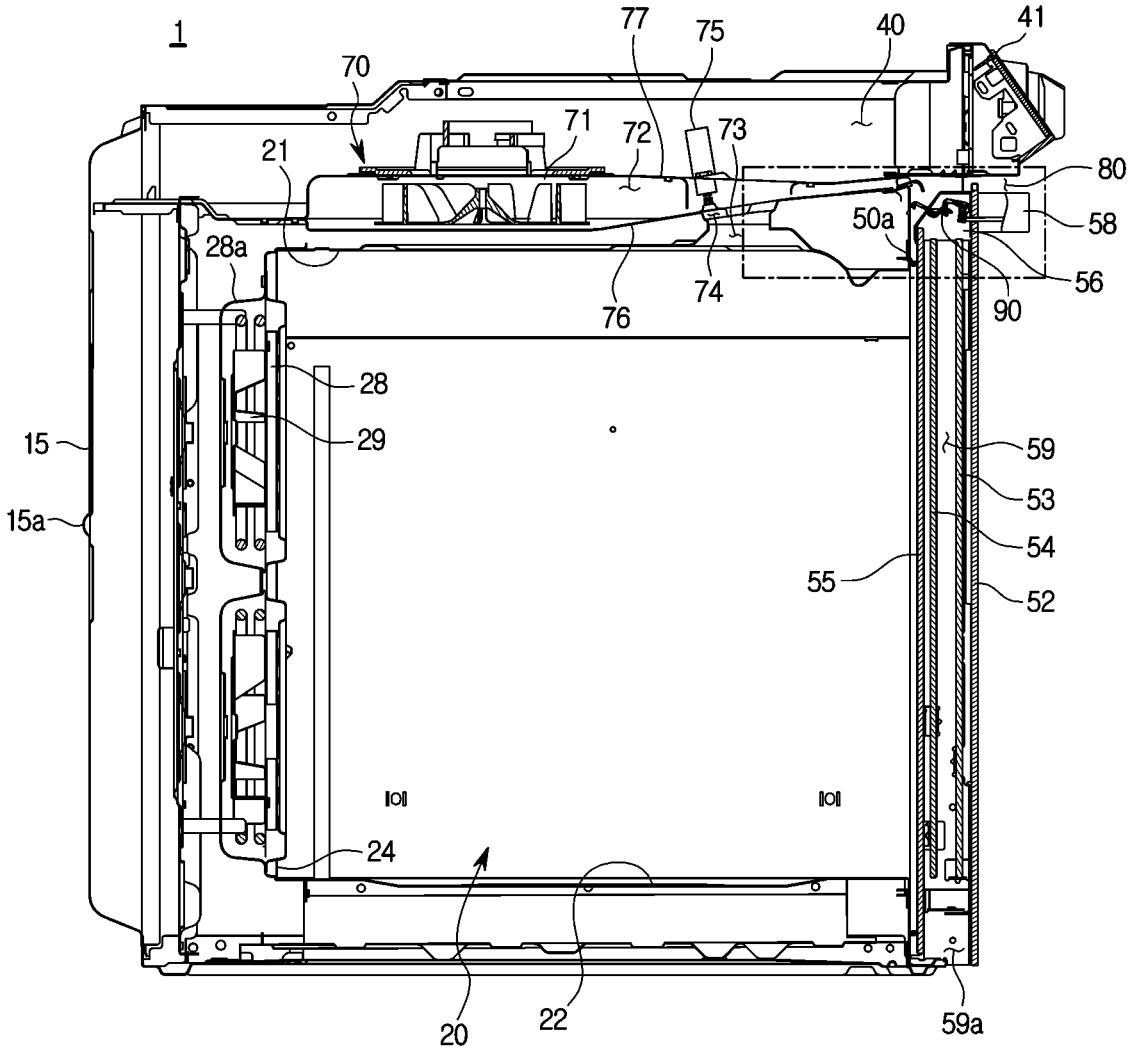
FIG. 3 is a side cross-sectional view of the oven according to the present disclosure.

FIG. 1 is a perspective view of an oven according to the present disclosure. FIG. 2 illustrates a state in which a door of the oven according to the present disclosure is opened. FIG. 3 is a side cross-sectional view of the oven according to the present disclosure.

As illustrated in FIGS. 1 to 3, an oven 1 may include a main body 10 an inner case (not shown) in which a cooking chamber 20 is formed, and an outer case 12 coupled to the outside of the inner case (not shown) to form an exterior of the oven 1.

The inner case (not shown) and the outer case 12 may each have a substantially box shape with an open front.

The oven 1 may include a cooktop 30 disposed on the top of the oven 1 to place and heat a container containing food. The oven 1 may include a door 50 disposed on the front of the main body 10 to open and close the cooking chamber 20.

The outer case 12 may include a front panel 13 forming a front surface of the main body 10, a side panel 14 forming a side surface of the main body 10, and a rear panel 15 forming a rear surface of the main body 10.

An opening is provided on the front panel 13, and the front of the cooking chamber 20 provided inside the main body 10 may be opened by the opening. An electric component room cover 41 covering a front side of an electric component room 40 may be provided on a front upper portion of the front panel 13. A display module 60 may be mounted on the electric component room cover 41.

The rear panel 15 may be provided with an inlet 15*a* so that air is sucked into the electric component room 40. Air sucked into the electric component room 40 through the inlet 15*a* flows through the electric component room 40 to cool electric components.

However, the present disclosure is not limited thereto, and the inlet 15*a* may be formed at various positions within a limit in which outside air may be guided to be sucked into the electric component room 40.

The cooking chamber 20 provided inside the main body 10 and having a box shape with an open front may be formed by a top plate 21, a bottom plate 22, opposite side plates 23, and a rear plate 24. The front of the cooking chamber 20, which is a cooking space, is opened through the opening of the front panel 13 so that food may be put in and out therethrough.

A plurality of support bars 25 may be provided on inner surfaces of the opposite side plates 23. At least one detachable rack 26 on which food may be placed may be mounted on the plurality of support bars 25.

Rails (not shown) may be installed on the plurality of support bars 25 so that the rack 26 may slide. A user may move the rack 26 through the rails (not shown) to take out or place food.

A divider (not shown) capable of dividing the cooking chamber 20 into a plurality of spaces may be detachably mounted on the plurality of support bars 25. The plurality of spaces of the cooking chamber 20 divided by the divider do not have to have the same size, and each size thereof may be different from each other.

Through this configuration, the user may variously utilize the plurality of spaces of the cooking chamber 20 according to the intention. The divider may be made of an insulating material to insulate each space of the cooking chamber 20.

A heater 27 for heating food may be provided in the cooking chamber 20, and the heater 27 may be an electric heater including an electric resistor. However, the present disclosure is not limited thereto, and the heater 27 may be a gas heater that generates heat by burning gas. Accordingly, the oven may include an electric oven and a gas oven.

A circulation fan 28 for circulating air in the cooking chamber 20 so that food is heated evenly and a circulation motor 29 for driving the circulation fan 28 may be mounted on the rear plate 24 of the cooking chamber 20.

A fan cover 28*a* covering the circulation fan 28 may be disposed on a front side of the circulation fan 28, and outlet holes 28*b* through which air may flow may be formed on the fan cover 28*a*.

The opened front of the cooking chamber 20 is opened and closed by the door 50, and the door 50 may be coupled to a lower portion of the main body 10 by hinges 57 to be rotatable with respect to the main body 10.

A handle 58 may be provided on a front upper portion of the door 50 so that the user may grip the door 50 to open and close the cooking chamber 20.

The display module 60, which displays information on various operations of the oven 1 and allows the user to input an operation command, may be mounted on the electric component room cover 41 provided on the front upper portion of the front panel 13. An operation unit 62 for operating the oven 1 may be provided on the electric component room cover 41.

The display module 60 may include a liquid crystal display (LCD), and the liquid crystal display may display electrical information as visual information by using a change in liquid crystal transmittance according to an applied voltage.

The liquid crystal display may include a liquid crystal module displaying an image and a light source unit emitting light to the liquid crystal module, and an LED (light emitting diode) may be used as the light source unit.

The display module 60 may include a cover panel 61 provided on a front surface of the liquid crystal display. The cover panel 61 may simply be a protective panel for protecting the liquid crystal display, but may be a touch panel capable of receiving a touch command of the user.

Various components constituting the oven 1 may be installed in a space between the inner case (not shown) in which the cooking chamber 20 is formed and the outer case 12 that forms the exterior of the oven 1. In addition, the electric component room 40 for accommodating electrical components that control the operation of various components including the display module 60 may be provided in the space.

An insulating material (not shown) to insulate the electric component room 40 and the cooking chamber 20 to prevent heat in the cooking chamber 20 from being transmitted to the electric component room 40 may be provided between the electric component room 40 and the cooking chamber 20.

The insulating material (not shown) may not only be provided between the electric component room 40 and the cooking chamber 20, but also may be provided to cover the entire outside of the cooking chamber 20 so that heat in the cooking chamber 20 is not transmitted to the outside of the oven 1.

Because the temperature inside the electric component room 40 may rise due to the heat of various electrical components, the oven 1 may be provided with a blowing device 70 capable of cooling the electric component room 40 by circulating air around the electric component room 40.

The blowing device 70 may include a blowing fan 71 for flowing air, and a discharge passage 72 provided to discharge air sucked by the blowing fan 71 to the front of the oven 1.

The blowing fan 71 may suck air in an axial direction and then discharge the sucked air in a radial direction. That is, the blowing fan 71 according to the present disclosure may be a centrifugal fan. However, the present disclosure is not limited thereto, and unlike the present embodiment, the blowing fan 71 may include an axial fan.

Outside air may be sucked into the electric component room 40 through the inlet 15*a* formed on the rear panel 15, and the air sucked into the electric component room 40 may flow through the inside of the electric component room 40 to cool the electrical components, and then may be discharged to the front of the oven 1 through a discharge port 80 along the discharge passage 72.

The discharge port 80 may include a space between the front panel 13 and the electric component room cover 41. However, the present disclosure is not limited thereto, and the discharge port 80 may be provided at various positions and may have various shapes within a limit in which air sucked through the inlet 15*a* may be discharged to the outside of the main body 1.

A part of the air in the cooking chamber 20 may be sucked to the discharge passage 72 side through a cooking chamber passage 73 and discharged to the front of the oven 1.

A bypass hole 74 may be formed to allow a part of air flowing from the discharge passage 72 to the discharge port 80 to be introduced into the cooking chamber passage 73, and the bypass hole 74 may be opened and closed by an opening and closing device 75.

An amount of a part of air in which air flowing from the discharge passage 72 to the discharge port 80 is introduced into the cooking chamber passage 73 is adjust as the bypass hole 74 is opened or closed by the opening and closing device 75, so that an amount of air exhausted from the cooking chamber 20 to the cooking chamber passage 73 may be adjusted.

The blowing device 70 may include a passage base 76 disposed above the cooking chamber 20, and a passage cover 77 provided to cover the passage base 76.

The discharge passage 72 may be formed by the passage base 76 and the passage cover 77. The discharge passage 72 may be formed by the passage base 76, the passage cover 77, and an upper portion of the front panel 13.

The passage base 76 and the passage cover 77 may be spaced apart from each other, and the blowing fan 71 and the like may be disposed in a space between the passage base 76 and the passage cover 77.

The door 50 rotatably coupled to the front surface of the main body 10 to open and close the cooking chamber 20 may include a first door 51 rotatably coupled to the front surface of the main body 10, and a second door 52 rotatably coupled to a front surface of the first door 51. The handle 58 may be provided on an upper portion of a front surface of the second door 52 to be gripped by a user.

The first door 51 may include a front glass 53 installed on the front surface thereof, a rear glass 55 installed on the rear of the front glass 53 to seal the cooking chamber 20, and an intermediate glass 54 installed between the front glass 53 and the rear glass 55.

A support frame 56 may be provided above the first door 51 to support the front glass 53, the rear glass 55, and the intermediate glass 54.

A first opening 91 (see FIG. 4) through which a locking device 90 penetrates may be provided at a central portion of the support frame 56. A third opening 93 through which the locking device 90 penetrates may be provided in an upper central portion of the front panel 13.

The first door 51 is consists of the plurality of glasses 53, 54, and 55, so that the inside of the cooking chamber 20 may be seen from the outside even when the first door 51 closes the cooking chamber 20.

The second door 52 may be made of an opaque material. A second opening 92 (see FIG. 4) may be provided on an upper central portion of the second door 52 at a position corresponding to the first opening 91 of the first door 51.

When both the first door 51 and the second door 52 are closed, heat inside the cooking chamber 20 may be doubly blocked by the first door 51 and the second door 52, so that the heat inside the cooking chamber 20 may be effectively prevented from being released to the outside.

Because the second door 52 may be made of an opaque material, the heat inside the cooking chamber 20 may be further effectively prevented from being released to the outside, and a surface temperature of the second door 52 may be lowered, so that safety may be improved, such as preventing burns when the user grips the handle 58 provided on the second door 52.

A color of the second door 52 may be freely set to match colors around the oven 1, so that an exterior design in harmony with other kitchen appliances may be implemented.

In the case of checking a cooking state of food being cooked inside the cooking chamber 20, when only the second door 52 is opened without both the first door 51 and the second door 52 being opened, the inside of the cooking chamber 20 may be seen through the first door 51, so that heat inside the cooking chamber 20 may be released to the outside, as well as the inside of the cooking chamber 20 may be seen from the outside.

However, the present disclosure is not limited thereto, and may be configured such that only some of the spaces of the cooking chamber 20 divided by the divider (not shown) in the cooking chamber 20 may be used when only the second door 52 is opened, and all the spaces inside the cooking chamber 20 may be used when both the first door 51 and the second door 52 are opened.

In order to open only the second door 52 by gripping the handle 58 provided on a front upper portion of the second door 52 or to open the first door 51 and the second door 52 together, the locking device 90 may be provided on a rear surface of the handle 58.

Looking at a cooking process in the oven 1, the user may close the cooking chamber 20 by placing food on the rack 26 supported by the plurality of support bars 25 and then closing the door 50.

Thereafter, the heater 27 is operated through the operation unit 62 provided on the electric component room cover 41 to generate heat, and at the same time the circulation fan 28 may rotate by the circulation motor 29.

In the cooking process in the oven 1, the temperature inside the cooking chamber 20 may rise, and the heat in the cooking chamber 20 may be transmitted to the door 50 located in front of the cooking chamber 20.

Because the door 50 is a part that is frequently touched by the user, it may be an important task to reduce a discomfort when the user touches the door 50 of the oven 1 where the temperature has risen.

Figure 4:
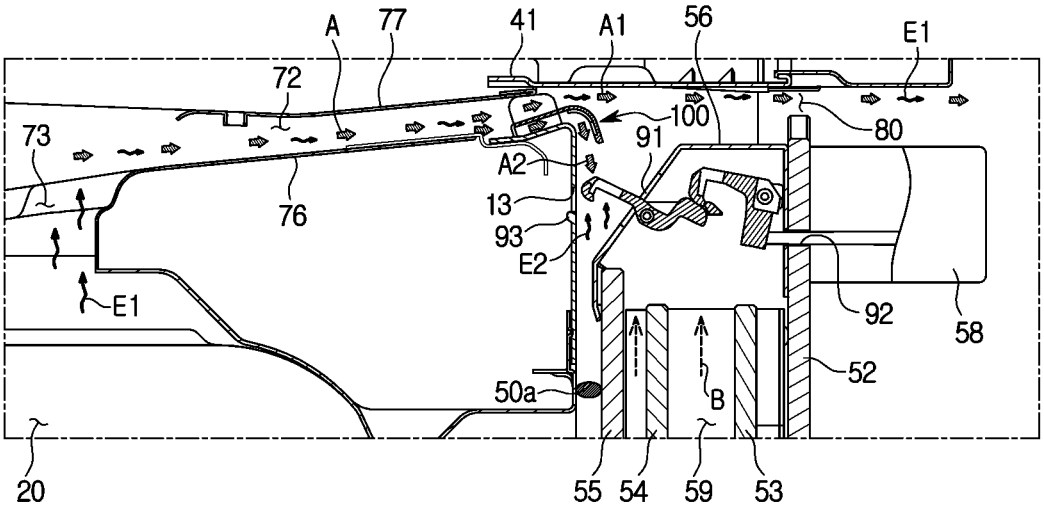
FIG. 4 illustrates that the flow of air discharged through a discharge passage is separated by an air guide in an oven according to an embodiment of the present disclosure.
Figure 5:
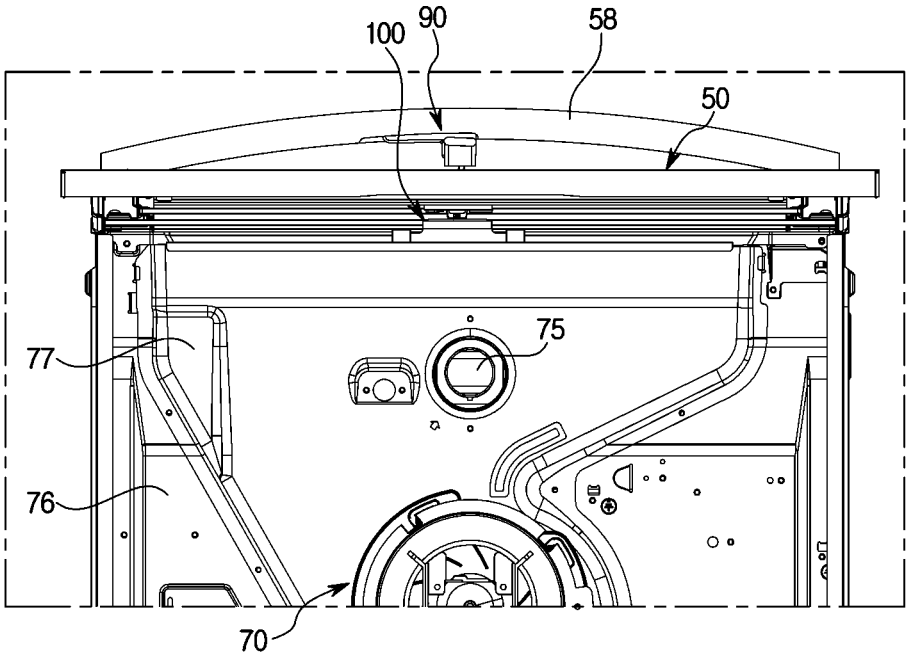
FIG. 5 illustrates that the air guide is disposed in a position opposite to the position of a locking device in an oven according to an embodiment of the present disclosure.

FIG. 4 illustrates that the flow of air discharged through a discharge passage is separated by an air guide in an oven according to an embodiment of the present disclosure. FIG. 5 illustrates that the air guide is disposed in a position opposite to the position of a locking device in an oven according to an embodiment of the present disclosure.

As illustrated in FIGS. 4 and 5, in general, when a user using an oven 1 (see FIG. 1) grips the door 50, particularly the handle 58, which has an excessively high temperature or is condensed with moisture, the user may feel uncomfortable.

Therefore, cooling the temperature of the door 50, in particular the handle 58, and preventing moisture from condensing on the handle 58 may be important in improving the quality of the oven 1.

In order to cool the door 50 heated by heat in the cooking chamber 20, the oven 1 may include the blowing fan 71 (see FIG. 3) to cool the electric component room 40 (see FIG. 3) and the inlet 15*a* (see FIG. 2) through which outside air may be introduced into the door 50.

The door 50 may include at least one door passage 59 in a space between the plurality of glasses 53, 54, and 55 to cool the door 50.

The present embodiment illustrates that the first door 51 (see FIG. 2) includes one of the intermediate glass 54, but is not limited thereto, and a plurality of the intermediate glasses 54 may be included, and thus a plurality of the door passages 59 may be provided corresponding to the number of the intermediate glasses 54.

Looking at a general cooling process of the door 50, the blowing fan 71 may cool the electric component room 40 by sucking outside air through the inlet 15*a*, and then may discharge the air through the discharge port 80.

Specifically, when a width of the discharge passage 72 becomes relatively narrow toward the discharge port 80, the velocity of air discharged may relatively increase in order for the same amount of air to pass through the discharge port 80.

As the velocity of air increases, the pressure of the air may become relatively lower than the atmospheric pressure, and accordingly, the Venturi effect may occur in which atmospheric pressure air is naturally sucked into a position where the pressure of the air is lowered.

As such, the door 50 may be cooled by utilizing a phenomenon in which ambient air is collected to an upper portion of the door 50 as the pressure at the upper portion of the door 50 from which the discharged air exits is relatively lowered.

That is, the cooling process of the door 50 may begin with the introduction of outside air through a door inlet 59*a* (see FIG. 3) provided at a lower end portion of the door 50. An introduced air B may rise to the upper portion of the door 50 along the door passage 59 due to the Venturi effect, thereby cooling the door 50.

When food is cooked using the oven 1, the internal temperature of the cooking chamber 20 may rise to 150 to 450 degrees Celsius depending on the cooking conditions. Moisture contained in the food to be cooked may evaporate due to an increase in the internal temperature of the cooking chamber 20, and the inside of the cooking chamber 20 may increase in pressure due to the increase in temperature.

In order to prevent a consumer accident due to an increase in the internal pressure of the cooking chamber 20, high-temperature and high-humidity water vapor E1 may be discharged to the discharge passage 72 having a relatively low pressure through the cooking chamber passage 73 provided above the cooking chamber 20.

The high-temperature and high-humidity water vapor discharged to the discharge passage 72 may be discharged to the outside of the oven 1 together with air A discharged through the discharge passage 72. At this time, the discharged high-temperature and high-humidity water vapor E1 comes into contact with the handle 58 of the door 50, so that moisture condensation may occur on the handle 58.

The door 50 may include a gasket 50*a* disposed between the door 50 and the front panel 13 to seal the inside of the cooking chamber 20. The gasket 50*a* may be made of a material having elasticity.

The elasticity of the gasket 50*a* provided between the door 50 and the front panel 13 may be weakened due to continuous use of the oven 1, and thus a defect may occur in contact between the door 50 and the front panel 13.

Due to poor contact between the door 50 and the front panel 13, high-temperature and high-humidity water vapor E2 inside the cooking chamber 20 may leak between the front panel 13 disposed in the front of the cooking chamber 20 and the door 50, and in this case, the leaked high-temperature and high-humidity water vapor E2 may cause moisture condensation on the handle 58 of the door 50.

To prevent this, the oven 1 according to the present disclosure may include an air guide 100 disposed at one end of the discharge passage 72 to separate the flow of the air A discharged through the discharge passage 72. The air guide 100 may separate the flow of air discharged through the discharge passage 72 into an upper part and a lower portion part.

The air guide 100 may be disposed on an upper portion of the front panel 13. The air guide 100 may be disposed between the front panel 13 and the passage cover 77. The air guide 100 may be disposed between the front panel 13 and the electric component room cover 41.

However, the present disclosure is not limited thereto, and the air guide 100 may be disposed at various positions within a limit in which the flow of the air A discharged through the discharge passage 72 may be separated.

The air guide 100 may move a part A1 of the air A discharged through the discharge passage 72 upward to prevent the water vapor E1 discharged to the discharge passage 72 through the cooking chamber passage 73 from coming into contact with the handle 58 together with the air A discharged through the discharge passage 72.

Therefore, as the air A1 moved upward by the air guide 100 is discharged through the discharge port 80, the water vapor E1 discharged to the discharge passage 72 through the cooking chamber passage 73 may be relatively prevented from coming into contact with the handle 58.

In particular, moisture condensation may occur relatively easily on a portion of the handle 58 located in the vicinity of the locking device 90.

In general, the handle 58 and the front surface of the door 50 may be spaced apart from each other, and outside air rises between the handle 58 and the front of the door 50 due to the Venturi effect, so that the air discharged through the discharge port 80 may move upward. Accordingly, condensation of moisture on the handle 58 may be prevented.

However, as the locking device 90 is disposed in a space between the handle 58 and the front surface of the door 50, outside air rising in the vicinity of the locking device 90 may be disturbed by the locking device 90.

Therefore, in particular, it may be relatively greatly required to prevent moisture from condensing on a portion of the handle 58 positioned in the vicinity of the locking device 90.

The air guide 100 according to the present disclosure may be disposed at a position opposite to the position of the locking device 90 to prevent moisture from condensing on a portion of the locking device 90 disposed between the handle 58 and the front surface of the door 50.

The air guide 100 may be disposed in the vicinity of the locking device 90. For example, when the locking device 90 is disposed at an intermediate point of the handle 58 as in this embodiment, the air guide 100 may also be disposed at an intermediate point of the front panel 13 to face the locking device 90. However, the present disclosure is not limited thereto.

The air guide 100 may move a part A2 of the air A discharged through the discharge passage 72 downward to prevent the water vapor E2 in the cooking chamber 20 leaking between the front panel 13 and the door 50 from coming into contact with the handle 58 together with the air A discharged through the discharge passage 72.

Accordingly, as the air A2 moved downward by the air guide 100 presses the water vapor E2 in the cooking chamber 20 leaking between the front panel 13 and the door 50 to disperse the water vapor E2 to the left and right, the water vapor E2 in the cooking chamber 20 leaking between the front panel 13 and the door 50 may be relatively prevented from coming into contact with the handle 58.

Figure 6:
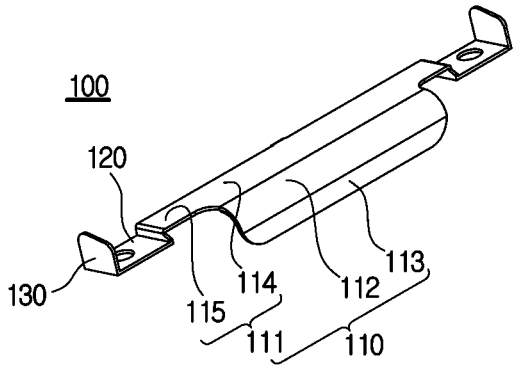
FIG. 6 is a perspective view of the air guide in the oven according to an embodiment of the present disclosure.
Figure 7:
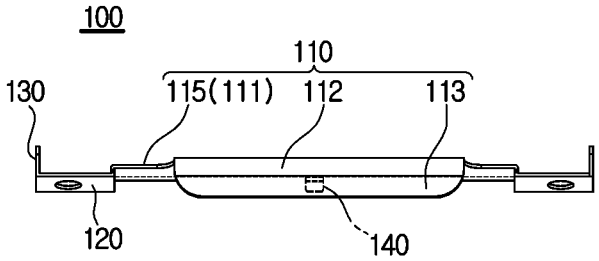
FIG. 7 is a front view of the air guide in the oven according to an embodiment of the present disclosure.
Figure 8:
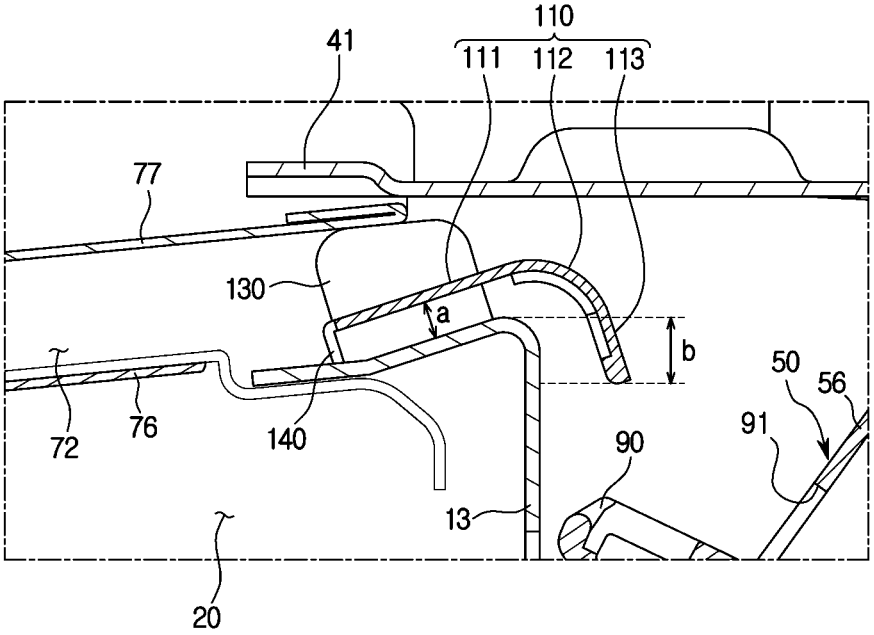
FIG. 8 illustrates that the air guide is mounted on one end of the discharge passage in the oven according to an embodiment of the present disclosure.

FIG. 6 is a perspective view of the air guide in the oven according to an embodiment of the present disclosure. FIG. 7 is a front view of the air guide in the oven according to an embodiment of the present disclosure. FIG. 8 illustrates that the air guide is mounted on one end of the discharge passage in the oven according to an embodiment of the present disclosure.

As illustrated in FIGS. 6 to 8, the air guide 100 may include a guide part 110 to guide air discharged through the discharge passage 72, and a mounting part 120 extending from the guide part 110 to mount the air guide 100.

The air guide 120 may be installed on the upper portion of the front panel 13 through the mounting part 120. The mounting part 120 may be installed on the upper portion of the front panel 13 by screw coupling or welding. However, the present disclosure is not limited thereto.

A plurality of the mounting parts 120 may be provided. According to this embodiment, two of the mounting parts 120 may be disposed on opposite sides of the guide part 110, respectively. However, the present disclosure is not limited thereto.

The guide part 110 may include a first guide portion 111 spaced apart from the mounting part 120 to separate the flow of air discharged through the discharge passage 72, and a second guide portion 112 extending from the first guide part 111 to move a part of air discharged through the discharge passage 72 downward.

The first guide portion 111 may be spaced apart upward from the mounting part 120. The first guide portion 111 may be spaced apart from the upper portion of the front panel 13. The first guide portion 111 may be spaced apart upward from the upper portion of the front panel 13.

A distance a at which the first guide portion 111 is spaced apart upward from the upper portion of the front panel 13 may be 1 mm or more. This is to secure a space through which the air A2 (see FIG. 4) moving downward through the air guide 100 passes.

The distance a at which the first guide portion 111 is spaced apart upward from the upper portion of the front panel 13 may be 4 mm or less. This is to secure a space through which the air A1 (see FIG. 4) moving upward through the air guide 100 passes. However, the present disclosure is not limited thereto.

The first guide portion 111 may have a planar shape. The first guide portion 111 may be parallel to the upper portion of the front panel 13 by having the same shape as the shape of the upper portion of the front panel 13 that is spaced apart therefrom.

However, the present disclosure is not limited thereto, and the shape of the first guide portion 111 may be variously formed within a limit in which the flow of the air A (see FIG. 4) discharged through the discharge passage 72 may be separated into an upper part and a lower part.

The second guide portion 112 may extend downward from the first guide portion 111. The second guide portion 112 may be bent from the first guide portion 111. The second guide portion 112 may have a curved shape.

However, the present disclosure is not limited thereto, and the second guide portion 112 may be connected to the first guide portion 111 in various structures and may have various shapes within a limit in which the air A discharged through the discharge passage 72 may move downward.

The first guide portion 111 may include a main body portion 114 from which the second guide portion 112 extends, and a connection portion 115 extending from the main body portion 114 so that the first guide portion 111 is connected to the mounting part 120.

The guide part 110 may include a third guide portion 113 extending from the second guide portion 112. The third guide portion 113 may extend downward from the second guide portion 112. The third guide portion 113 may be bent from the second guide portion 113.

A distance b between one end of the third guide portion 113 and the upper portion of the front panel 13 may be 1.5 mm or more.

The larger the distance b between the one end of the third guide portion 113 and the upper portion of the front panel 13, the greater the effect that the water vapor E2 (see FIG. 4) in the cooking chamber 20 leaking between the front panel 13 and the door 50 may be suppressed through the air A2 discharged by moving downward through the discharge passage 72.

However, the air guide 100 is exposed to the outside when the door 50 (see FIG. 5) is opened, and the distance b between the one end of the third guide portion 113 and the upper portion of the front panel 13 may be determined within a limit that the appearance quality of the oven 1 (see FIG. 1) is not degraded.

The third guide portion 113 may have a planar shape. However, the present disclosure is not limited thereto, and the third guide portion 113 may have various shapes within a limit in which the air A2 discharged by moving downward through the discharge passage 72 may suppress the water vapor E2 in the cooking chamber 20 that is guided by the second guide portion 112 and leaks between the front panel 13 and the door 50.

The air guide 100 may include a cover support part 130 supporting the passage cover 77 to maintain a spacing between the passage base 76 and the passage cover 77.

Local sagging may occur in the passage cover 77 during the assembling process of the oven 1 or due to continuous use of the oven 1.

Therefore, the cover support part 130 prevents sagging of the passage cover 77 to maintain the spacing between the passage base 76 and the passage cover 77, so that an amount of the air A discharged through the discharge passage 72 may be maintained.

That is, a height of the cover support part 130 may be equal to a distance between the upper portion of the front panel 13 and the passage cover 77. However, the present disclosure is not limited thereto.

The cover support part 130 may extend from the mounting part 120. The cover support part 130 may be bent from the mounting part 120. A plurality of the cover support parts 130 may be provided. Two of the cover support parts 130 may be disposed on two of the mounting parts 120, respectively.

However, the present disclosure is not limited thereto, and the cover support part 130 may be disposed in various positions, and may be provided in various numbers, within a limit in which the cover support part 130 may support the passage cover 77 to maintain the spacing between the passage base 76 and the passage cover 77.

The air guide 100 may include a guide support part 140 supporting the first guide portion 111 to maintain a spacing between the front panel 13 and the first guide portion 111.

Local sagging may occur in the first guide portion 111 during the assembling process of the oven 1 or due to continuous use of the oven 1.

Therefore, the guide support part 140 prevents sagging of the first guide portion 111 to maintain a spacing between the first guide portion 111 and the upper portion of the front panel 13, so that an amount of the air A2 discharged by moving downward through the discharge passage 72 may be maintained.

That is, a height of the guide support part 140 may be equal to a distance between the upper portion of the front panel 13 and the first guide portion 111. However, the present disclosure is not limited thereto.

The guide support part 140 may extend from the first guide portion 111. The guide support part 140 may be bent from the first guide portion 111. A plurality of the guide support parts 140 may be provided. According to this embodiment, one of the guide support part 140 may be disposed at an intermediate point of the first guide portion 111.

However, the present disclosure is not limited thereto, and the guide support part 140 may be disposed in various positions and may be provided in various numbers, within a limit in which the guide support part 140 may support the first guide portion 111 to maintain the spacing between the first guide portion 111 and the upper portion of the front panel 13.

Figure 9:
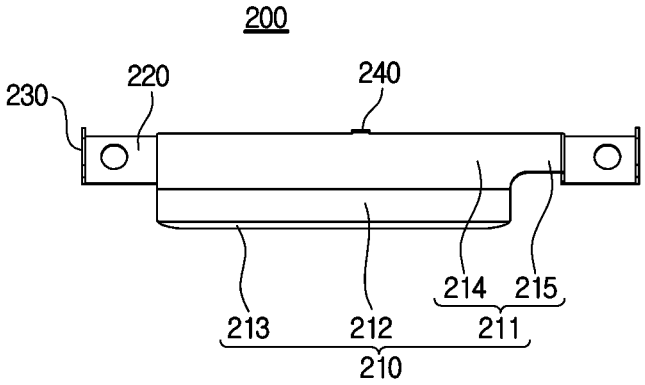
FIG. 9 is a plan view of an air guide in an oven according to another embodiment of the present disclosure.
Figure 10:
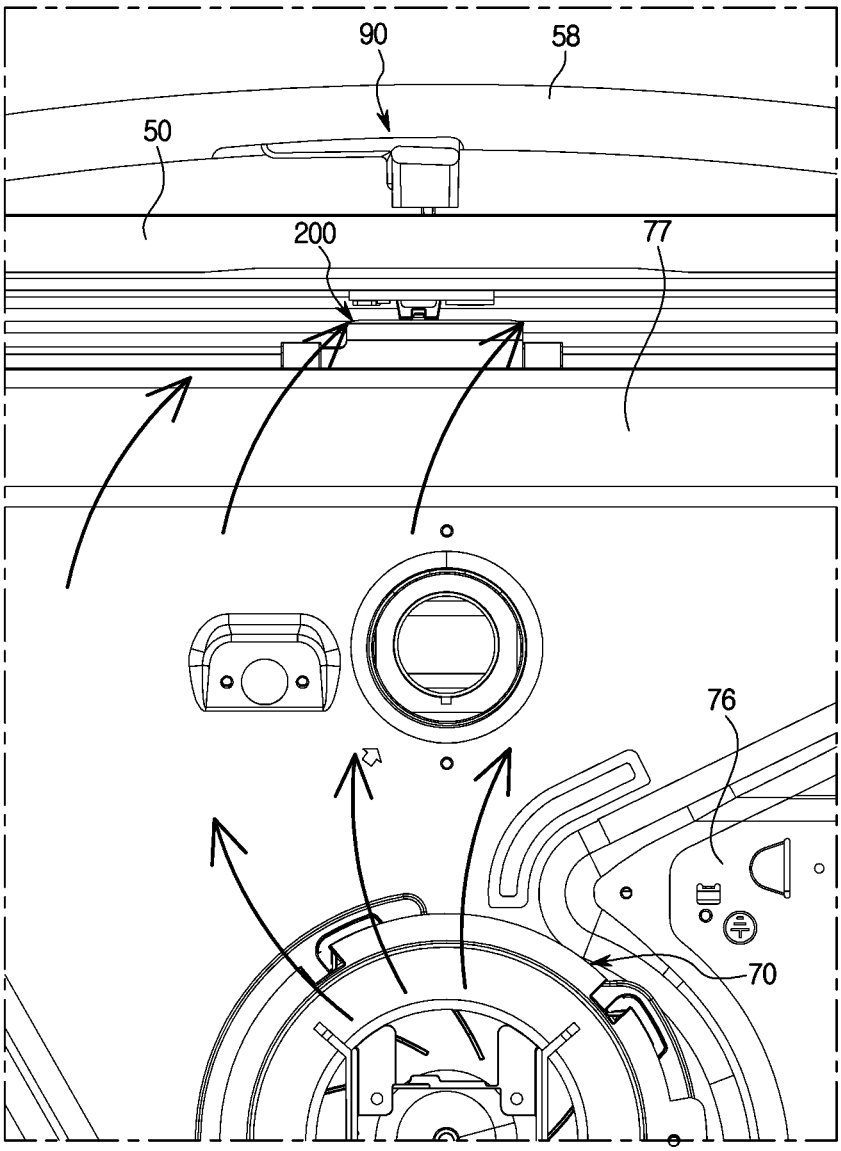
FIG. 10 illustrates a relationship between an air guide and air discharged through a discharge passage in the oven according to another embodiment of the present disclosure.

FIG. 9 is a plan view of an air guide in an oven according to another embodiment of the present disclosure. FIG. 10 illustrates a relationship between an air guide and air discharged through a discharge passage in the oven according to another embodiment of the present disclosure.

An air guide 200 according to another embodiment of the present disclosure is generally the same as the air guide 100 (see FIG. 6) according to an embodiment of the present disclosure, but there may be different in the structure of a guide part 210.

Hereinafter, focusing on differences from the air guide 100 according to an embodiment of the present disclosure, the air guide 200 according to another embodiment of the present disclosure will be described.

As illustrated in FIGS. 9 and 10, the air guide 200 may include a guide part 210 to guide air discharged through the discharge passage 72 (see FIG. 8), and a mounting part 220 extending from the guide part 210 to mount the air guide 200.

The guide part 210 may include a first guide portion 211 spaced apart from the mounting part 220 to separate the flow of air discharged through the discharge passage 72, and a second guide portion 212 extending from the first guide part 211 to move a part of air discharged through the discharge passage 72 downward.

The guide part 210 may include a third guide portion 213 extending from the second guide portion 212. The air guide 100 may include a cover support part 230 supporting the passage cover 77 to maintain a spacing between the passage base 76 and the passage cover 77.

The air guide 200 may include a guide support part 240 supporting the first guide portion 211 to maintain a spacing between the front panel 13 (see FIG. 8) and the first guide portion 211.

A plurality of the mounting parts 220 may be provided. Two of the mounting parts 220 may be disposed on opposite sides of the guide part 210, respectively.

The first guide portion 211 may include a main body portion 214 connected to the second guide portion 212 and connected to the one mounting part 220 of the plurality of mounting parts 220, and a connection portion 215 extending from one side of the main body portion 214 and connected to the other mounting part 220 of the plurality of mounting parts 220.

Accordingly, in the air guide 200 according to another embodiment of the present disclosure, unlike the air guide 100 according to an embodiment of the present disclosure, only one of the connection portion 215 is provided on one side of the first guide portion 211, so that lengths of the main body portion 214, the second guide portion 212, and the third guide portion 213 may be relatively longer than those of the air guide 100 according to an embodiment of the present disclosure.

That is, one ends of the first guide portion 211, the second guide portion 212, and the third guide portion 213 may be disposed on the same line.

In general, as widths of the main body portion 214, the second guide portion 212, and the third guide portion 213 increase, an amount of the air A2 (see FIG. 4) discharged by moving downward through the discharge passage 72 may increase, and thus the water vapor E2 (see FIG. 4) in the cooking chamber 20 (see FIG. 8) leaking between the front panel 13 and the door 50 may be further effectively suppressed.

However, in consideration of the increase in the material cost of the air guide 200 and the resistance of the air A (see FIG. 4) discharged through the discharge passage 72 by the air guide 200, the widths of the main body portion 214, the second guide portion 212, and the third guide portion 213 may need to be limited.

Therefore, in consideration of the point that the air flowing by the blowing fan 71 (see FIG. 4) generally rotates in a clockwise direction, although the right ends (based on FIG. 10) of the second guide portion 212 and the third guide portion 213 are disposed on the same line as the right end of the first guide portion 211, all of the guide portions may contribute to move the air A discharged through the air guide 200 downward.

On the other hand, in a case where the left ends (based on FIG. 10) of the second guide portion 212 and the third guide portion 213 are disposed on the same line as the left end of the first guide portion 211, portions of the second guide portion 212 and the third guide portion 213 may not contribute to move the air A discharged through the air guide 200 downward.

That is, the air A discharged through the air guide 100 may not pass to the front of the connection portion 114 (see FIG. 6) positioned on the left side (based on FIG. 10) of the air guide 100 according to an embodiment of the present disclosure.

Accordingly, the air guide 200 according to another embodiment of the present disclosure may be configured such that only the right ends of the second guide portion 212 and the third guide portion 213 are disposed on the same line as the right end of the first guide portion 211.

However, the present disclosure is not limited thereto, and the right ends of the second guide portion 212 and the third guide portion 213 may extend more to the right than the right end of the first guide portion 211 by a length corresponding to the width of the connection portion 215.

While the present disclosure has been particularly described with reference to exemplary embodiments, it should be understood by those of skilled in the art that various changes in form and details may be made without departing from the spirit and scope of the present disclosure.

The invention claimed is:

1. An oven comprising:

a main body having a cooking chamber;

a door configured to open and close the cooking chamber;

a handle disposed at an upper portion of a front surface of the door;

a blowing fan disposed above the cooking chamber to blow air sucked from outside of the main body;

a discharge passage configured to allow air sucked by the blowing fan to be discharged to the outside of the main body; and an air guide disposed at one end of the discharge passage to separate the flow of air discharged through the discharge passage into an upper part and a lower part, wherein the air guide comprises a guide part configured to guide the air discharged through the discharge passage, and a mounting part formed to extend from the guide part to allow the guide part to be mounted, and wherein the guide part comprises a first guide portion spaced upward from the mounting part to separate the flow of the air discharged through the discharge passage, and a second guide portion bent downward from the first guide portion to move a part of the air discharged through the discharge passage downward.

2. The oven according to claim 1, wherein the air guide is disposed at an upper portion of a front panel provided on a front of the main body.

3. The oven according to claim 1, further comprising a cooking chamber passage provided at an upper portion of the cooking chamber to discharge air in the cooking chamber to the discharge passage, wherein the air guide is configured to move another part of the air discharged through the discharge passage upward to prevent water vapor discharged to the discharge passage through the cooking chamber passage from coming into contact with the handle together with air discharged through the discharge passage.

4. The oven according to claim 2, wherein the discharge passage is formed by a passage base disposed above the cooking chamber and a passage cover covering the passage base, and the air guide is disposed between an upper portion of the front panel and the passage cover.

5. The oven according to claim 2, further comprising an electric component room provided above the cooking chamber to accommodate electric components, and an electric component room cover covering a front surface of the electric component room, wherein the air guide is disposed between the upper portion of the front panel and the electric component room cover.

6. The oven according to claim 1, wherein the door comprises a locking device configured to connect the door to the main body and to detach from the door of the main body, and the air guide is disposed at a position opposite to the position of the locking device to prevent moisture from condensing on a portion of the locking device disposed between the front surface of the door and the handle.

7. The oven according to claim 1, wherein the air guide is configured to move the part of air discharged through the discharge passage downward to prevent water vapor in the cooking chamber leaking between the main body and the door from coming into contact with the handle together with the air discharged through the discharge passage.

8. The oven according to claim 1, wherein the first guide portion comprises a main body portion from which the second guide portion extends, and a connection portion formed to extend from the main body portion so that the first guide portion is connected to the mounting part.

9. The oven according to claim 8, wherein the guide part further comprises a third guide portion bent downward from the second guide portion.

10. The oven according to claim 9, wherein the first guide portion and the third guide portion are formed in a plane, and the second guide portion is formed in a curved surface.

11. The oven according to claim 4, wherein the air guide comprises a cover support part configured to support the passage cover to maintain a spacing between the passage base and the passage cover.

12. The oven according to claim, wherein the air guide comprises a guide support part configured to support the first guide portion to maintain a spacing between the mounting part and the first guide portion.

13. The oven according to claim 1, wherein a plurality of the mounting parts is provided at opposite sides of the first guide portion, and the first guide portion comprises a main body portion connected to the second guide portion and connected to one of the plurality of mounting parts, and a connection portion formed to extend from one side of the main body portion and connected to the other one of the plurality of mounting parts.

* * * * *